US007444720B2

(12) United States Patent
Huang

(10) Patent No.: US 7,444,720 B2
(45) Date of Patent: Nov. 4, 2008

(54) BUCKLE

(76) Inventor: Han-Ching Huang, No. 12, Alley 111, Lane 437, Chen Hsing Road, Taichung (TW)

( * ) Notice: Subject to any disclaimer, the term of this patent is extended or adjusted under 35 U.S.C. 154(b) by 60 days.

(21) Appl. No.: 11/457,574

(22) Filed: Jul. 14, 2006

(65) Prior Publication Data

US 2008/0010786 A1 Jan. 17, 2008

(51) Int. Cl.
*A44B 11/06* (2006.01)

(52) U.S. Cl. ..... 24/170

(58) Field of Classification Search ..... 24/134 K, 24/134 I, 170, 132 AA, 132, 132 R, 179, 24/265 CD; 248/220.13, 221.12
See application file for complete search history.

(56) References Cited

U.S. PATENT DOCUMENTS

| | | | | |
|---|---|---|---|---|
| 2,287,722 A | | 6/1942 | Beazley | 24/170 |
| 2,363,872 A | | 11/1944 | Kiessling | 24/170 |
| 3,312,502 A | * | 4/1967 | Coe | 297/481 |
| 3,678,542 A | * | 7/1972 | Prete, Jr. | 24/191 |
| 4,660,889 A | * | 4/1987 | Anthony et al. | 297/467 |
| 4,716,630 A | * | 1/1988 | Skyba | 24/134 R |
| 5,161,351 A | * | 11/1992 | Woodruff | 54/6.1 |
| 6,631,537 B1 | * | 10/2003 | Huang | 24/193 |
| 6,868,585 B2 | * | 3/2005 | Anthony et al. | 24/68 R |
| 6,868,587 B2 | * | 3/2005 | Rard | 24/170 |
| 2001/0022013 A1 | | 9/2001 | Hsieh | 24/170 |
| 2003/0037417 A1 | | 2/2003 | Shen | 24/334 |

FOREIGN PATENT DOCUMENTS

TW I249996 3/2006

OTHER PUBLICATIONS

German Patent Publication No. DE 2902553 A1, Jul. 31, 1980, 10 pages.

* cited by examiner

*Primary Examiner*—Robert J Sandy
(74) *Attorney, Agent, or Firm*—Alan Kamrath; Kamrath & Associates PA

(57) ABSTRACT

A buckle includes a base, a one-piece handle and an elastic element. The base is made of a metal sheet by pressing and includes two walls, a floor between the walls and a jaw between the walls. The one-piece handle is made of a metal sheet by pressing and includes a touch portion at an end and a jaw near the touch portion. The one-piece handle is installed on the base to define a gap between the jaw of the base and the jaw of the one-piece handle. The one-piece handle can be pivoted on the base between a first position where the gap is small and a second position where the gap is large. The elastic element tends to keep the one-piece handle in the first position.

15 Claims, 8 Drawing Sheets

BUCKLE

BACKGROUND OF INVENTION

1. Field of Invention

The present invention relates to a buckle and, more particularly, to a buckle that is manufactured with ease at a low cost.

2. Related Prior Art

Disclosed in Taiwanese Patent 1249996 is a buckle with a handle 2 pivotally installed on a base 1. The base 1 and the handle 2 are made of zinc-aluminum alloy in an extrusion process. A lot of material is used to form the base 1 and the handle 2. The base 1 and the handle 2 are thick and heavy. Furthermore, such zinc-aluminum alloy is soft so that the rigidity of both of the base 1 and the handle 2 is inadequate. Moreover, a lot of energy is consumed to heat and melt such zinc-aluminum alloy. In addition, it takes a long period of time for the base 1 and the handle 2 to cool down before they can be subject to finishing. Hence, the throughput is low. Furthermore, it costs a lot of money to develop molds for molding the base 1 and the handle 2.

The present invention is therefore intended to obviate or at least alleviate the problems encountered in the prior art.

SUMMARY OF INVENTION

According to the present invention, a buckle includes a base, a one-piece handle and an elastic element. The base is made of a metal sheet by pressing and includes two walls, a floor between the walls and a jaw between the walls. The one-piece handle is made of a metal sheet by pressing and includes a touch portion at an end and a jaw near the touch portion. The one-piece handle is installed on the base to define a gap between the jaw of the base and the jaw of the one-piece handle. The one-piece handle can be pivoted on the base between a first position where the gap is small and a second position where the gap is large. The elastic element tends to keep the one-piece handle in the first position.

An advantage of the buckle according to the present invention is fast manufacturing thereof.

Another advantage of the buckle according to the present invention is the use of a small amount of material.

Another advantage of the buckle according to the present invention is to provide a compact and light structure.

Another advantage of the buckle according to the present invention is firm clamping of a strap due to the use of the jaws biased by the elastic element.

Other advantages and features of the present invention will become apparent from the following description referring to the drawings.

BRIEF DESCRIPTION OF DRAWINGS

The present invention will be described through detailed illustration of two embodiments referring to the drawings.

DETAILED DESCRIPTION OF EMBODIMENTS

Figure 1:
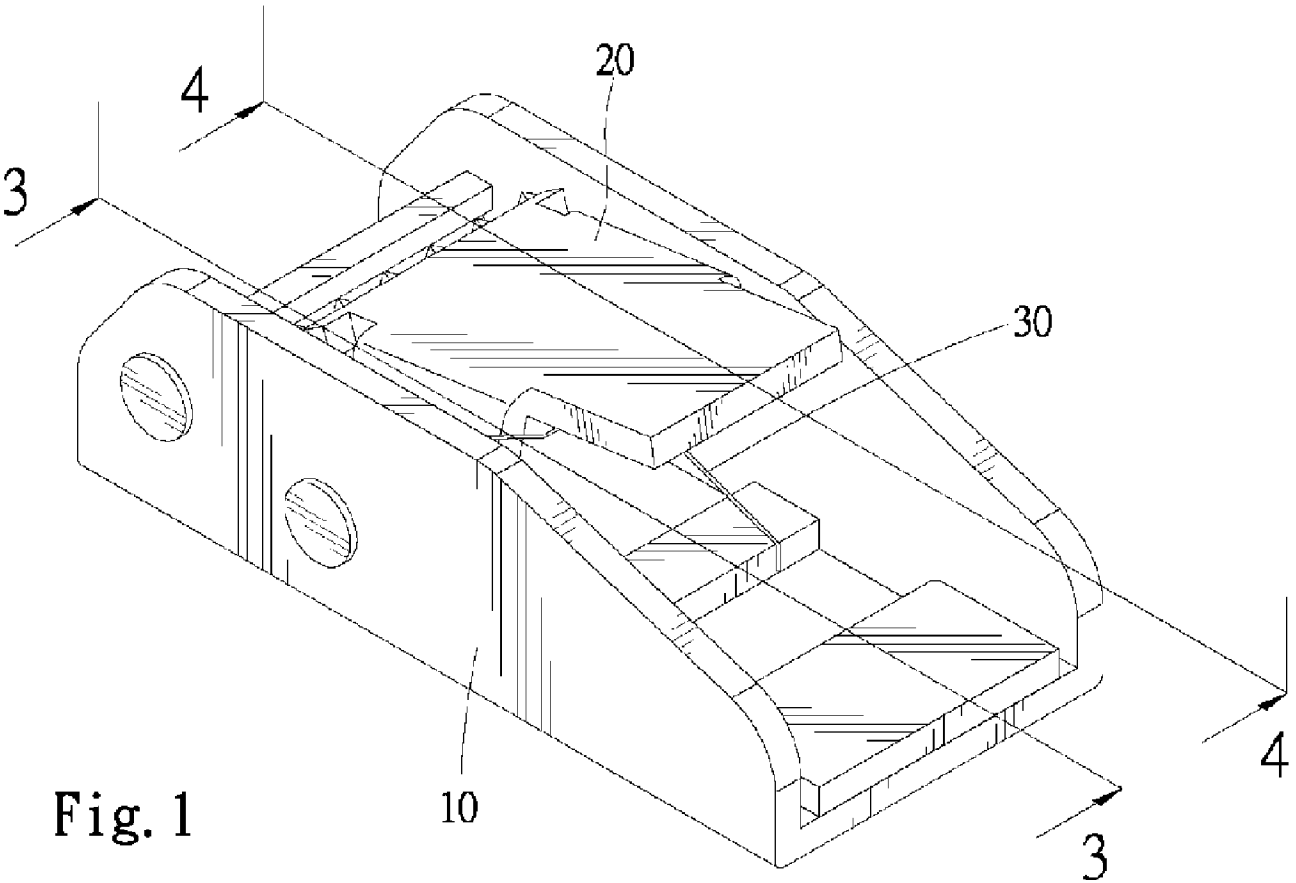
FIG. 1 is a perspective view of a buckle according to the first embodiment of the present invention.
Figure 2:
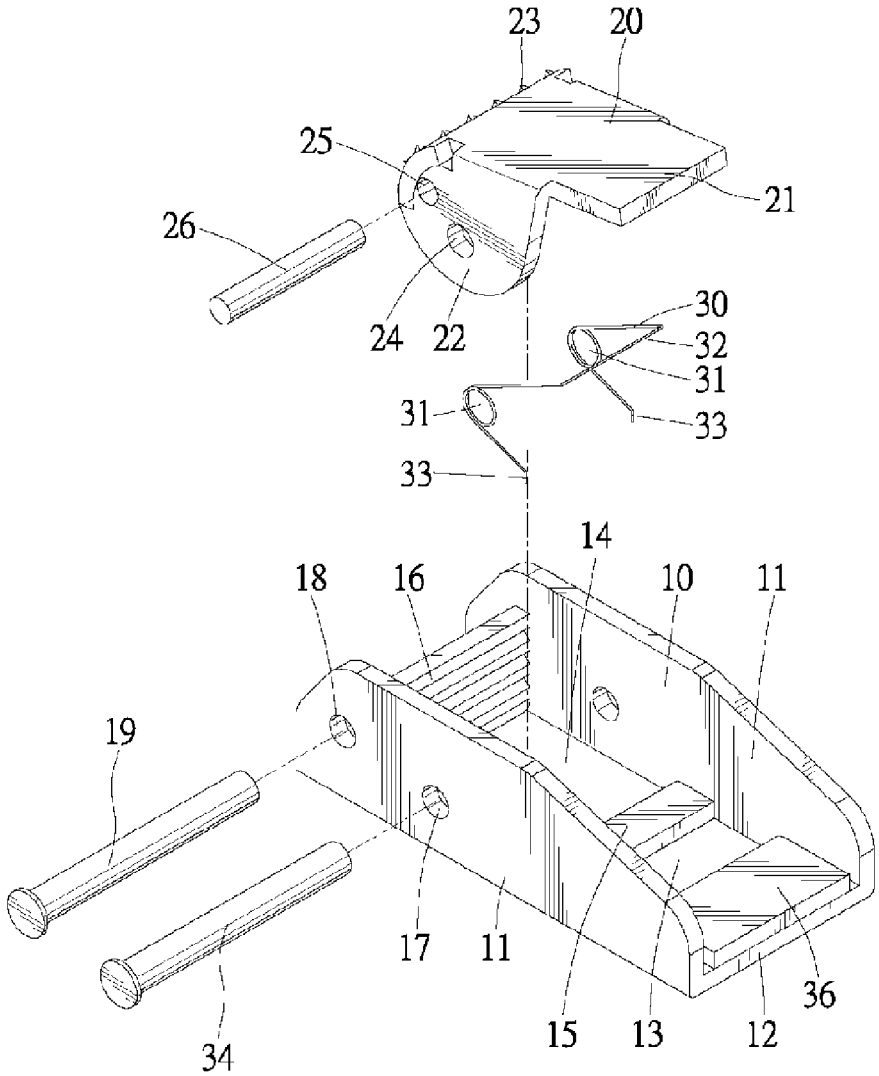
FIG. 2 is an exploded view of the buckle shown in FIG. 1.

Referring to FIGS. 1 and 2, there is shown a buckle according to a first embodiment of the present invention. The buckle includes a base 10, a one-piece handle 20 and an elastic element 30. The base 10 and the one-piece handle 20 are made of iron in a continuous pressing or punching process with ease at a low cost.

The base 10 is made of a first iron sheet including a middle portion and two lateral portions. In the continuous pressing process, the lateral portions of the first iron sheet are bent from the middle portion of the first iron sheet so that the former extend perpendicular to the latter. The lateral portions of the first iron sheet become walls 11 while the middle portion of the same becomes a floor 12. Hence, the base 10 is U-shaped in an end view.

Two apertures 17 and 18 are made in each of the walls 11.

The floor 12 is punched so that a portion 36 thereof is bent, leaving an opening 13 in the floor 12, and the floor 12 is punched so that a portion 16 thereof is bent, leaving an opening 14 in the floor 12. The portion 36 is laid on the floor 12 for reinforcing the base 10. The portion 16 is perpendicular to the floor 12. The portion 16 can hereinafter be referred to as the "jaw 16." The jaw 16 is made with grooves. The opening 13 is separated from the opening 14 by a cross-member 15 that is originally part of the floor 12.

Figure 3:
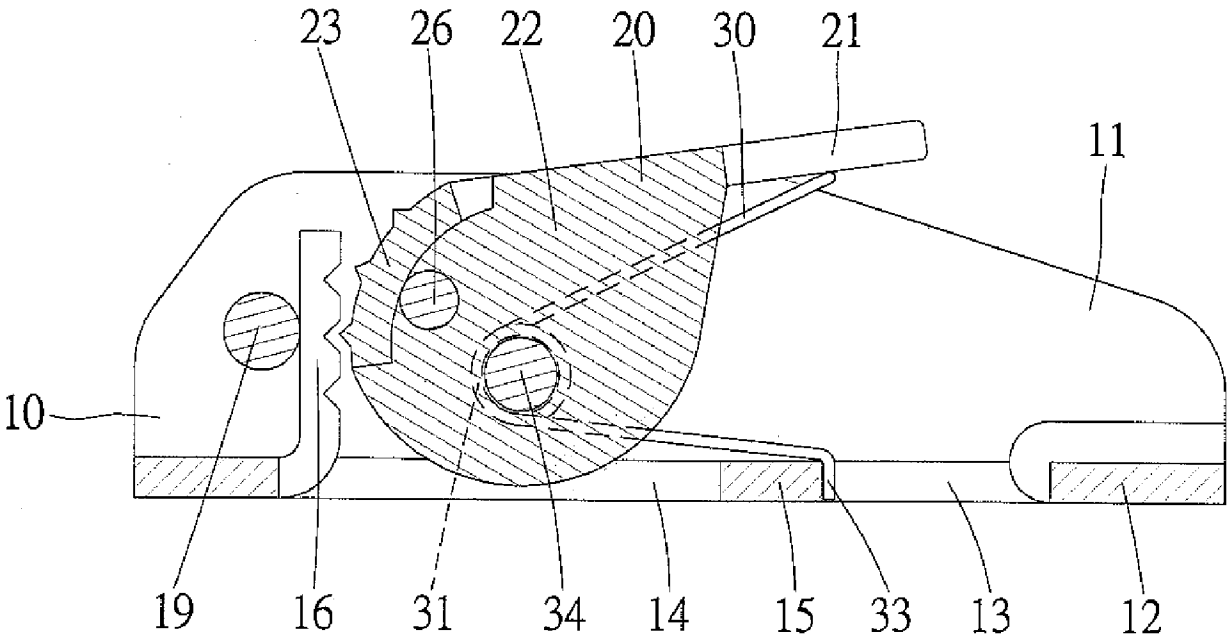
FIG. 3 is a cross-sectional view of the buckle taken along a line 3-3 in FIG. 1.
Figure 4:
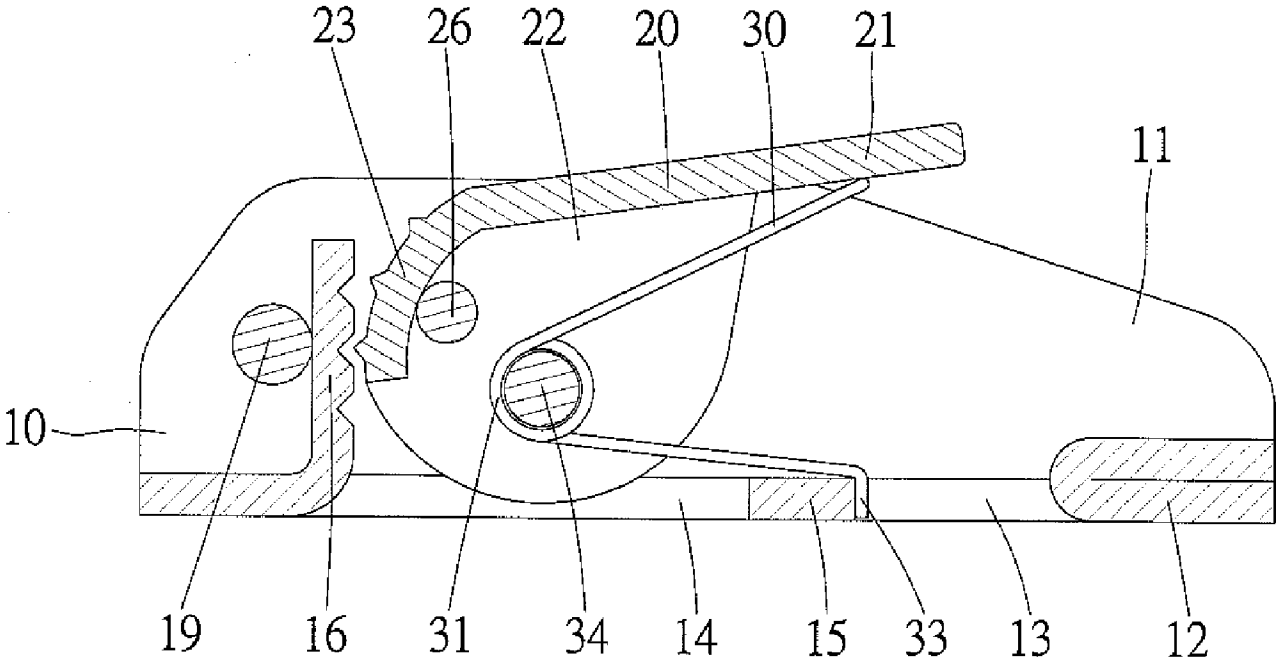
FIG. 4 is a cross-sectional view of the buckle taken along a line 3-3 in FIG. 1.
Figure 5:
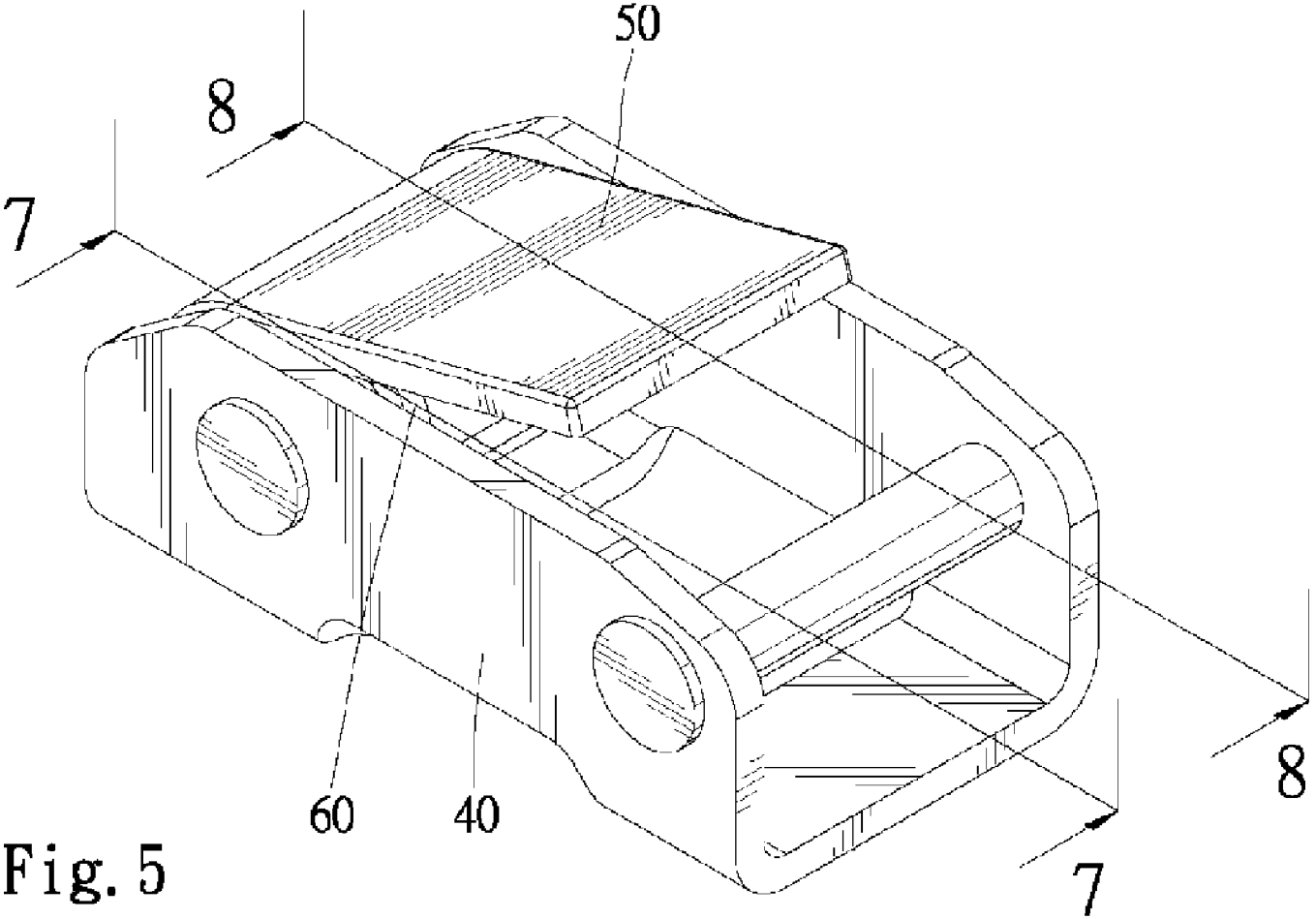
FIG. 5 is a perspective view of a buckle according to the second embodiment of the present invention.
Figure 6:
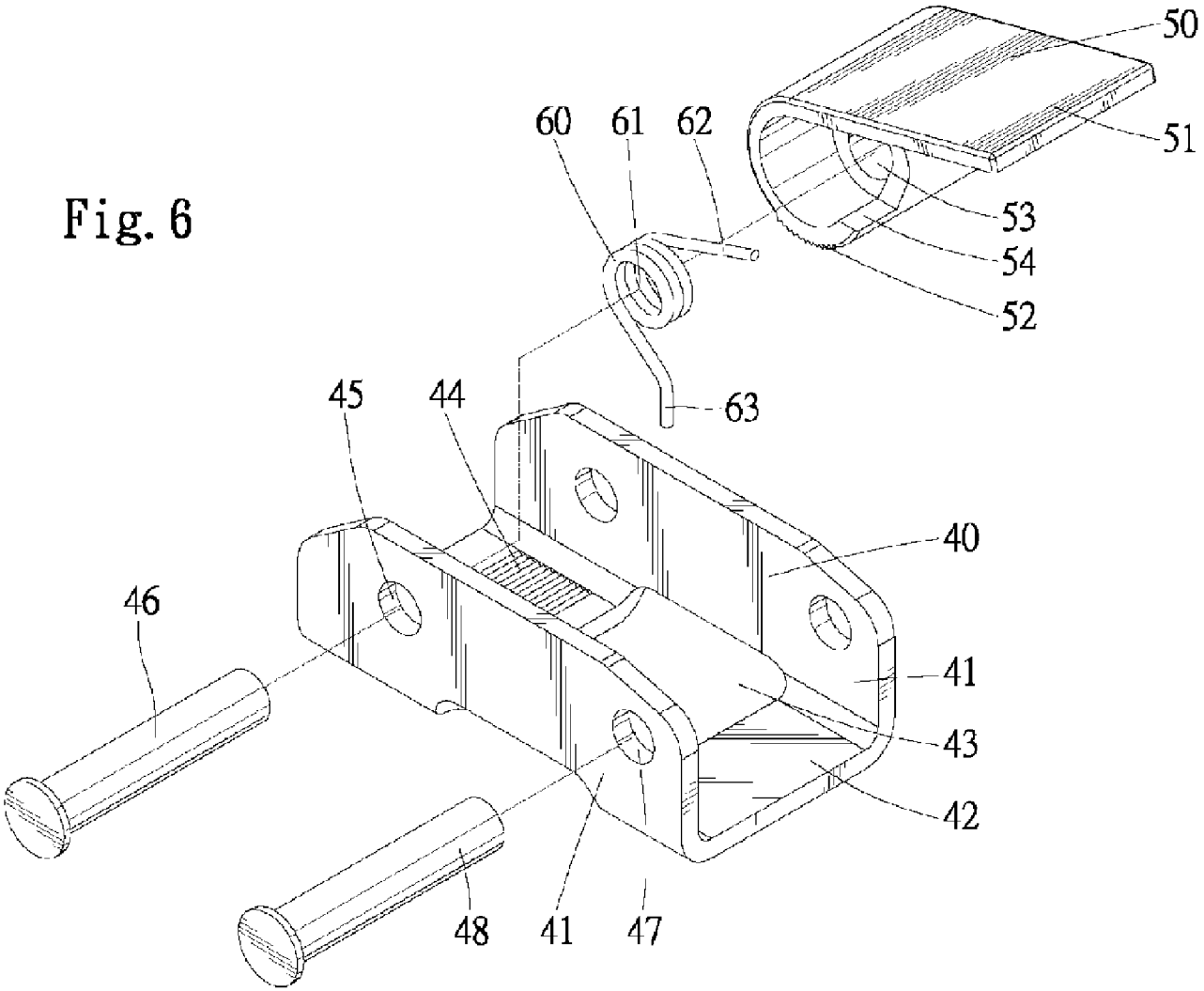
FIG. 6 is an exploded view of the buckle shown in FIG. 5.
Figure 7:
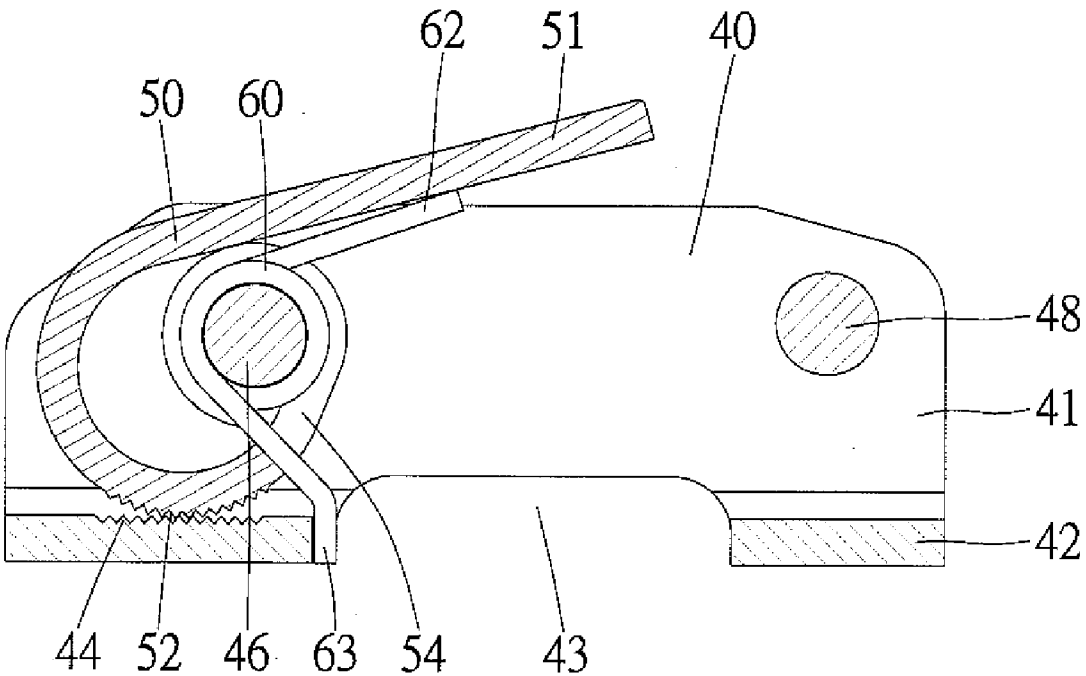
FIG. 7 is a cross-sectional view of the buckle taken along a line 7-7 in FIG. 5.
Figure 8:
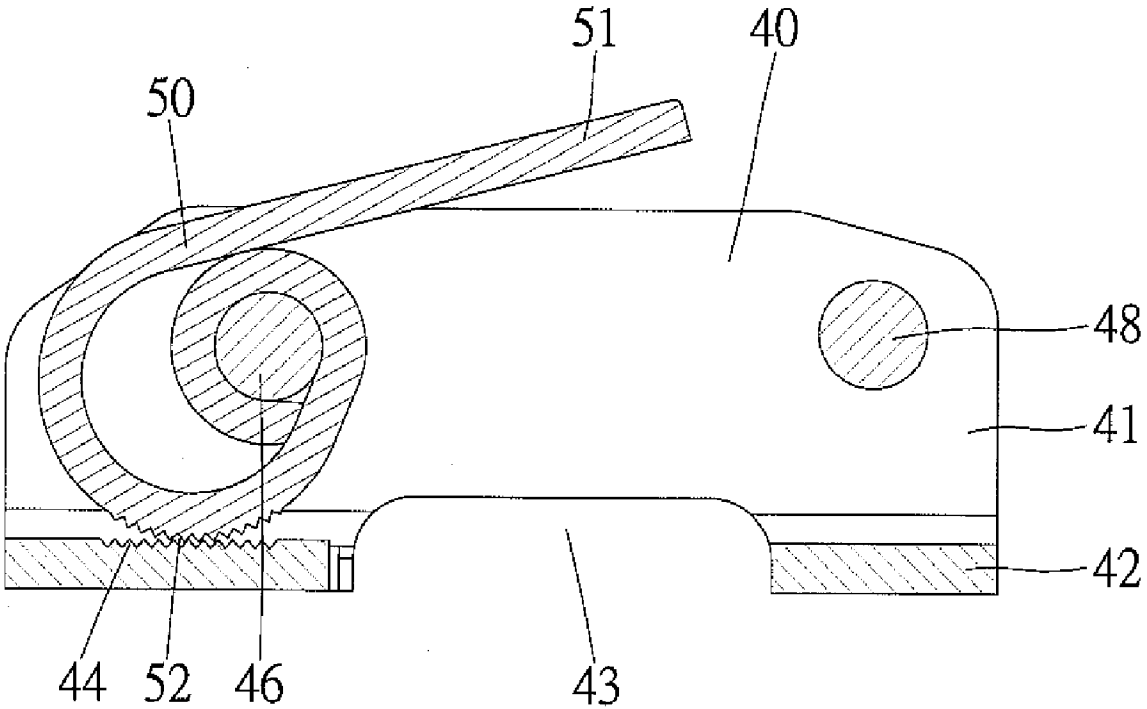
FIG. 8 is a cross-sectional view of the buckle taken along a line 8-8 in FIG. 5.

Referring to FIGS. 3 and 4, a bar 19 is inserted in the apertures 18. The bar 19 is used to support the jaw 16 for reinforcing the base 10.

The one-piece handle 20 is made of a second iron sheet including a middle portion and two lateral portions. In the continuous pressing process, the lateral portions of the second iron sheet are bent from the middle portion of the second iron sheet so that the former extend perpendicular to the latter. The lateral portions of the second iron sheet become cams 22 while the middle portion of the same becomes a touch portion 21. The middle portion of the second iron sheet is bent so that a jaw 23 is arched and supported by the cams 22. Two apertures 24 and 25 are made in each of the cams 22. The jaw 23 is made with a skid-proof face and, more particularly, teeth.

A bar 26 is inserted in the apertures 25. The bar 26 is used to support the jaw 23 for reinforcing the one-piece handle 20.

The elastic element 30 is made of an elastic steel rod. The elastic element 30 includes a middle portion 32 and two lateral portions. Each of the lateral portions of the elastic element 30 includes a helical portion 31 and an end 33 extended from the helical portion 31. The end 33 of each of the lateral portions of the elastic element 30 may be in the form of a hook.

A shaft 34 is inserted in the apertures 17 of the walls 11, the apertures 24 of the cams 22 and the helical portions 31 of the elastic element 30 so that the base 10, the one-piece handle 20 and the elastic element 30 are joined. The ends 33 of the elastic element 30 are located against the cross member 15 of the base 10 while the middle portion 32 of the elastic element 30 is located against the touch portion 21 so that the elastic element 30 tends to pivot the one-piece handle 20 from the base 10. There is a gap defined between the jaw 16 of the base 10 and the jaw 23 of the one-piece handle 20.

Referring to FIG. 3, the gap between the jaw 23 of the one-piece handle 20 and the jaw 16 of the base 10 is small.

Referring to FIG. 4, a user pivots the one-piece handle 20 towards the base 10 by the touch portion 21 so that the gap between the jaw 23 of the one-piece handle 20 and the jaw 16 of the base 10 becomes large for receiving a strap or belt.

Because of the elastic element 30, the one-piece handle 20 will be turned back to the position shown in FIG. 3 from the position shown in FIG. 4 if the user releases the one-piece handle 20. The gap between the jaw 23 of the one-piece handle 20 and the jaw 16 of the base 10 becomes small again for restraining the strap.

Referring to FIGS. 5 through 8, there is shown a buckle according to a second embodiment of the present invention. The buckle according to the second embodiment includes a base 40, a one-piece handle 50 and an elastic element 60. The base 40 and the one-piece handle 50 are made of iron in a continuous pressing or punching process.

The base 40 is made an iron plate. The base 40 includes a floor 42, a jaw 44 separated from the floor 42 by an opening 43 defined therein and two walls 41 between which the floor 42 and the jaw 44 extend. The jaw 44 is made with teeth. Two apertures 45 and 47 are made in each of the walls 41. A rivet 48 is fit in the apertures 47 of the walls 41 of the base 40 for reinforcing the base 40.

The one-piece handle 50 is made of an iron plate. The one-piece handle 50 includes a touch portion 51 formed at an end, a loop 53 formed at another end, a jaw 52 formed near the loop 53 and a cutout 54 made near the jaw 52.

The elastic element 60 is made of an elastic rod. The elastic element 60 includes a first end 62, a second end 63 and a helical portion 61 formed between the first end 62 and the second end 63. The second end 63 of the elastic element 60 may be in the form of a hook.

A shaft 46 is inserted in the apertures 45 of the walls 41 of the base 40, the loop 53 of the one-piece handle 50 and the helical portion 61 of the elastic element 60 so that the base 40, the one-piece handle 50 and the elastic element 60 are joined. The first end 62 of the elastic element 60 is located against the touch portion 51 of the one-piece handle 50 while the second end 63 of the same is inserted through the cutout 54 of the one-piece handle 50 and located against the jaw 44 of the base 40. Thus, the elastic element 60 tends to pivot the one-piece handle 50 from the base 40. A strap or belt can be inserted in a gap defined between the jaw 44 of the base 40 and the jaw 52 of the one-piece handle 50.

The buckle according to the present invention exhibits several advantages. Firstly, its manufacturing is fast. Secondly, a small amount of material is used. Thirdly, it is compact and light. Fourthly, it is strong for using the bars. Fifthly, it firmly clamps the strap due to the use of the jaws biased by the elastic element.

The present invention has been described via the detailed illustration of the embodiments. Those skilled in the art can derive variations from the embodiments without departing from the scope of the present invention. Therefore, the embodiments shall not limit the scope of the present invention defined in the claims.

What is claimed is:

1. A buckle comprising:

a base comprising two walls, a floor integrally formed with and between the two walls and a jaw integrally formed with the floor and between the two walls, with the two walls, the floor, and the jaw formed as a single piece from a metal sheet with the two walls bent from the floor and the jaw bent from the floor;

a one-piece handle comprising a touch portion formed at an end and a jaw formed near the touch portion, with the jaw of the one-piece handle and the touch portion formed as a single piece from a metal sheet with the jaw of the one-piece handle bent from the touch portion, wherein the one-piece handle is installed on the base to define a gap between the jaw of the base and the jaw of the one-piece handle, wherein the one-piece handle can be pivoted on the base between a first position where the gap is small and a second position where the gap is large; and an elastic element for keeping the one-piece handle in the first position.

2. The buckle according to claim 1 further comprising a shaft for pivotally supporting the one-piece handle on the base.

3. The buckle according to claim 1 wherein the jaw of the base is perpendicular to the floor.

4. The buckle according to claim 3 further comprising a bar installed on the two walls of the base for supporting the jaw of the base.

5. The buckle according to claim 1 wherein the one-piece handle comprises two cams between which the touch portion is formed and on which the jaw of the one-piece handle is located.

6. The buckle according to claim 5 wherein the cams of the one-piece handle are pivotally installed on the two walls of the base.

7. The buckle according to claim 6 further comprising a bar fit in the two cams of the one-piece handle for reinforcing the one-piece handle.

8. The buckle according to claim 6 further comprising a shaft driven in the two walls of the base and the two cams of the one-piece handle.

9. The buckle according to claim 1 wherein the elastic element provides torque between the base and the one-piece handle.

10. The buckle according to claim 9 wherein the elastic element comprises a helical portion, an end located against the base and another end located against the one-piece handle.

11. The buckle according to claim 10 further comprising a shaft inserted in the two walls of the base, the one-piece handle and the helical portion of the elastic element.

12. The buckle according to claim 9 wherein the elastic element comprises two lateral portions each comprising a helical portion and an end located against the base and a middle portion formed between the lateral portions and located against the one-piece handle.

13. The buckle according to claim 1, with the two walls of the base, the floor of the base and the jaw of the base having an equal thickness.

14. The buckle according to claim 13, with the jaw of the one-piece handle and the touch portion of the one-piece handle having an equal thickness.

15. The buckle according to claim 1, with the jaw of the one-piece handle and the touch portion of the one-piece handle having an equal thickness.

* * * * *